US008485160B2

(12) United States Patent
Li et al.

(10) Patent No.: US 8,485,160 B2
(45) Date of Patent: Jul. 16, 2013

(54) FUEL PRESSURE REGULATION SYSTEM

(75) Inventors: Hui Li, Regensburg (DE); Anselm Schwarte, Bad Abbach (DE)

(73) Assignee: Continental Automotive GmbH, Hannover (DE)

( * ) Notice: Subject to any disclaimer, the term of this patent is extended or adjusted under 35 U.S.C. 154(b) by 527 days.

(21) Appl. No.: 12/747,271

(22) PCT Filed: Nov. 3, 2008

(86) PCT No.: PCT/EP2008/064874
§ 371 (c)(1),
(2), (4) Date: Jun. 10, 2010

(87) PCT Pub. No.: WO2009/074399
PCT Pub. Date: Jun. 18, 2009

(65) Prior Publication Data

US 2010/0269794 A1 Oct. 28, 2010

(30) Foreign Application Priority Data

Dec. 10, 2007 (DE) ..... 10 2007 059 352

(51) Int. Cl.
*F02M 63/00* (2006.01)

(52) U.S. Cl.
USPC ..... 123/447; 123/479

(58) Field of Classification Search
USPC ..... 123/447, 457, 458, 479; 701/103–105, 701/107
See application file for complete search history.

(56) References Cited

U.S. PATENT DOCUMENTS

| | | | | |
|---|---|---|---|---|
| 6,142,120 | A | 11/2000 | Biester et al. | 123/456 |
| 7,059,302 | B2 | 6/2006 | Lemoure | 123/446 |
| 2010/0258083 | A1 * | 10/2010 | Adler et al. | 123/447 |

FOREIGN PATENT DOCUMENTS

| | | |
|---|---|---|
| DE | 19548278 | 6/1997 |
| DE | 19735938 | 2/1999 |
| DE | 10247564 | 4/2002 |
| DE | 10318827 | 2/2004 |
| DE | 102006018164 | 8/2007 |
| JP | 2003-322067 | * 11/2003 |

OTHER PUBLICATIONS

German Office Action for Application No. 10 2007 059 352.1 (4 pages), Jul. 24, 2008.
International Search Report for Application No. PCT/EP2008/064874 (6 pages), Mar. 30, 2009.

* cited by examiner

*Primary Examiner* — Hai Huynh
(74) *Attorney, Agent, or Firm* — King & Spalding L.L.P.

(57) ABSTRACT

In a fuel pressure regulating system for an internal combustion engine, having a pressure accumulator storing fuel under pressure and feeding injectors providing the combustion chambers of the internal combustion engine with fuel, a high-pressure pump feeding a fuel mass flow into the pressure accumulator, a first valve for throttling the fuel mass flow, a second valve by means of which fuel can be discharged from the pressure accumulator, and a control unit for actuating the valves, the control unit determines a fuel mass flow required by the pressure accumulator depending on a prescribed target pressure in the pressure accumulator, divides the determined fuel mass flow into a partial mass flow fed in by the first valve and discharged by the second valve, and actuates the valves according to the partial mass flows.

18 Claims, 4 Drawing Sheets

FUEL PRESSURE REGULATION SYSTEM

CROSS-REFERENCE TO RELATED APPLICATIONS

This application is a U.S. National Stage Application of International Application No. PCT/EP2008/064874 filed Nov. 3, 2008, which designates the United States of America, and claims priority to German Application No. 10 2007 059 352.1 filed Dec. 10, 2007, the contents of which are hereby incorporated by reference in their entirety.

TECHNICAL FIELD

The present invention relates to a fuel pressure regulation system for an internal combustion engine, said system having a pressure accumulator which stores fuel under pressure and feeds injectors providing combustion chambers of the internal combustion engine with fuel, a high-pressure pump which supplies a fuel mass flow to the pressure accumulator, a first valve for throttling the fuel mass flow, a second valve via which fuel can be discharged from the pressure accumulator, and a control unit for actuating the valves.

BACKGROUND

In a fuel pressure regulation system of said kind, which is often used in common-rail injection systems, the pressure in the pressure accumulator is regulated in that a closed-loop pressure control circuit is formed in which the first valve is used as a final control element. In this case the second valve serves as a protective pressure relief means. Alternatively the pressure is regulated by means of a closed-loop pressure control circuit in which the second valve is used as a final control element.

However, said two closed-loop control circuits must be coordinated in such a way that only one of the two is active at any given time. This gives rise to difficulties in particular when it comes to the switchover or transition from one closed-loop control circuit to the other.

Which of the two closed-loop control circuits is active is often chosen as a function of the operating point of the internal combustion engine. The inactive closed-loop control circuit is then set to a predetermined value.

This approach requires an initialization of the two control circuits. This is associated with high overhead, for example in terms of implementing the regulation function by programming measures.

SUMMARY

According to various embodiments, a fuel pressure regulation system of the type cited in the introduction can be developed in such a way that regulating the pressure in the pressure chamber is made easier.

According to an embodiment, a fuel pressure regulation system for an internal combustion engine, may comprise a pressure accumulator which stores fuel under pressure and feeds injectors supplying combustion chambers of the internal combustion engine with fuel, a high-pressure pump which supplies a fuel mass flow to the pressure accumulator, a first valve for throttling the fuel mass flow, a second valve via which fuel can be discharged from the pressure accumulator, and a control unit for actuating the valves, wherein the control unit determines a fuel mass flow required by the pressure accumulator as a function of a predefined setpoint pressure in the pressure accumulator, splits the determined fuel mass flow into a mass flow fraction that is to be supplied via the first valve and a mass flow fraction that is to be discharged via the second valve, and actuates the valves according to the mass flow fractions.

According to a further embodiment, the control unit may superimpose the operating ranges of the two valves in such a way that a continuous operating range is present from negative to positive fuel mass flows to the pressure accumulator. According to a further embodiment, the control unit may be embodied as an accumulator pressure regulator which acts simultaneously on the two valves which serve as final control elements. According to a further embodiment, in order to actuate the valves the control unit may use models in which the actuating signal of the respective valve is determined as a function of at least one operating parameter of the internal combustion engine and of the corresponding mass flow fraction. According to a further embodiment, the required fuel mass flow can be calculated by means of the sum of a precontrol fraction and a closed-loop control fraction as a function of at least one operating parameter of the internal combustion engine. According to a further embodiment, the precontrol fraction can be calculated on the basis of a model. According to a further embodiment, the precontrol fraction can be calculated such that the required fuel mass flow is yielded as the result from the setpoint pressure in the pressure accumulator and the fuel mass balance of the pressure accumulator. According to a further embodiment, the fuel mass balance can be calculated from the injection quantities, the switching leakages, the continuous leakages and the fuel mass stored in the pressure accumulator as a function of a setpoint change rate of the pressure in the pressure accumulator and as a function of the actuated valves. According to a further embodiment, the precontrol value can be calculated by resolving the fuel mass balance according to the valve dependencies.

According to another embodiment, in a fuel pressure regulation method for an internal combustion engine having a pressure accumulator which stores fuel under pressure and feeds injectors supplying combustion chambers of the internal combustion engine with fuel, a high-pressure pump which supplies a fuel mass flow to the pressure accumulator, a first valve for throttling the fuel mass flow, a second valve via which the fuel can be discharged from the pressure accumulator, a fuel mass flow required by the pressure accumulator is determined as a function of a predefined setpoint pressure in the pressure accumulator, the determined fuel mass flow is split into a mass flow fraction that is to be supplied via the first valve and a mass flow fraction that is to be discharged via the second valve, and the valves are actuated according to the mass flow fractions.

According to a further embodiment, the operating ranges of the two valves may be superimposed such that a continuous operating range is present from negative to positive fuel mass flows to the pressure accumulator. According to a further embodiment, an accumulator pressure regulation and control function may be realized which acts simultaneously on the two valves which serve as final control elements. According to a further embodiment, models can be used for the purpose of actuating the valves, in which models the actuating signal of the respective valve is determined as a function of at least one operating parameter of the internal combustion engine and of the corresponding mass flow fraction.

BRIEF DESCRIPTION OF THE DRAWINGS

The invention will be explained in more detail below by way of example with reference to the attached drawings in which.

DETAILED DESCRIPTION

Figure 1:
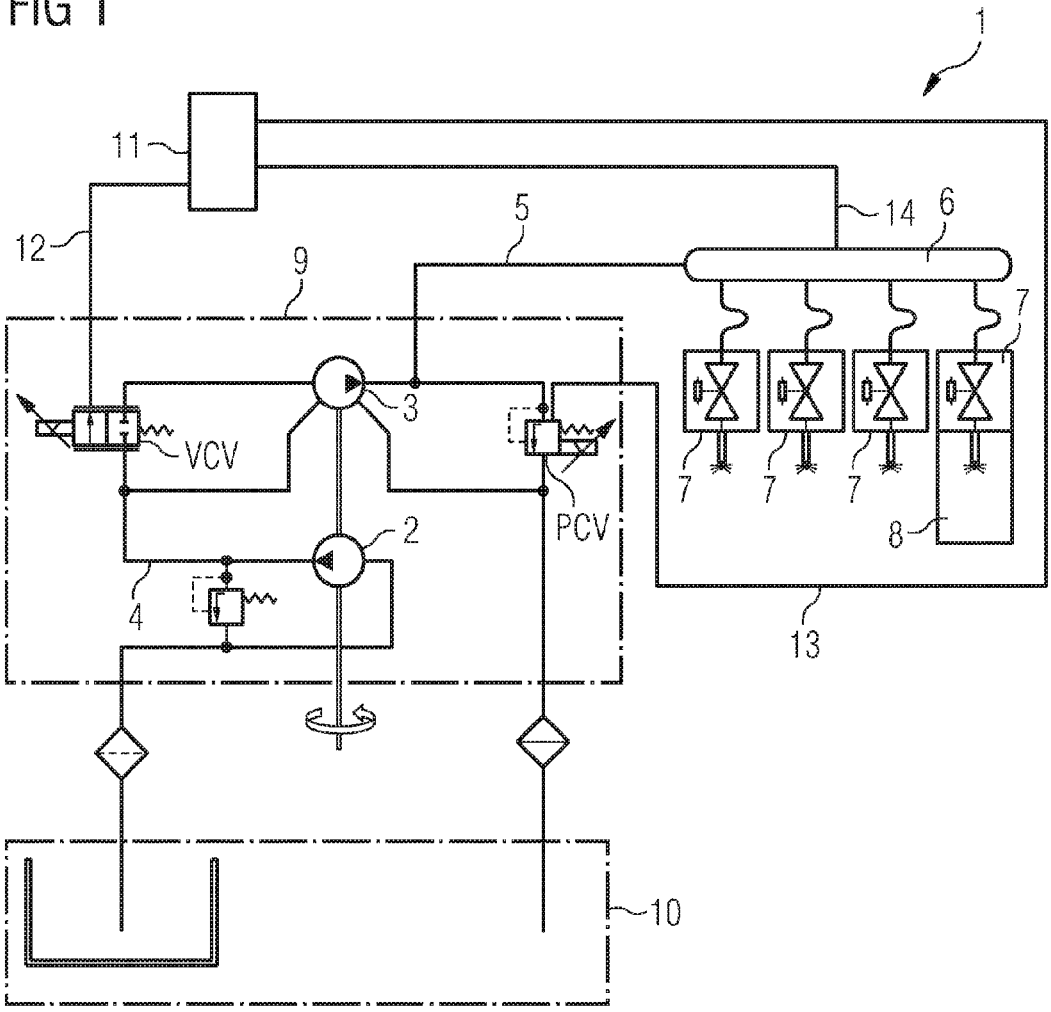
FIG. 1 shows a schematic view of a fuel pressure regulation system according to one embodiment.

According to various embodiments, in a fuel pressure regulation system of the type cited in the introduction, the control unit determines a fuel mass flow required by the pressure accumulator as a function of a predefined setpoint pressure in the pressure accumulator, splits the determined fuel mass flow into a mass flow fraction that is to be supplied via the first valve and a mass flow fraction that is to be discharged via the second valve, and actuates the valves according to the mass flow fractions.

By means of said control unit a regulator for the pressure of the pressure chamber is implemented which acts simultaneously on two final control elements (the two valves). This removes the need, as in the case of the known prior art fuel injection systems, for a switchover between two different closed-loop pressure control circuits, thereby simplifying the regulating function. Advantageously, furthermore, only a single closed-loop pressure control circuit is henceforth required in which the two valves are incorporated. This is achieved in particular in that the second valve is no longer taken into account in the conventional manner as a pressure valve, but is included as a mass flow valve in the common closed-loop control circuit. By this means it becomes possible to allow the control unit to act as a regulator simultaneously on both valves.

The fuel pressure regulation system according to various embodiments accordingly has a regulating and control structure which covers all operating states. In particular the software for the control unit can be reduced from two closed-loop control circuits for the conventional case to only one closed-loop control circuit or regulator in the case of the fuel pressure regulation system according to various embodiments. The implementation of the control function in the case of the fuel pressure regulation system according to various embodiments also entails substantially less overhead as a result of the elimination of the switchover as required in the case of a conventional fuel pressure regulation system having two closed-loop control circuits. This is also based on the fact, for example, that a coordination between two closed-loop control circuits and a corresponding initialization of the one or other closed-loop control circuit is no longer necessary.

What is to be understood by the fuel mass flow required by the pressure accumulator is the fuel mass flow that is to be supplied to the pressure accumulator or that is to be discharged from the pressure accumulator.

The first valve serves in particular for throttling the fuel mass flow flowing into the high-pressure pump.

The control unit determines the required fuel mass flow in particular as a function of the setpoint pressure and at least one operating parameter of the internal combustion engine. The operating parameter can be e.g. the rotational speed of the internal combustion engine, the fuel temperature, the injection quantity, the number of injections, etc.

The first valve preferably has an operating range in which the smallest value is a minimum positive mass flow and the largest value is a maximum positive mass flow. A positive mass flow is to be understood to mean a mass flow for supplying to the pressure accumulator. The second valve preferably has an operating range from a large negative mass flow in terms of absolute value to the mass flow zero.

A negative mass flow is to be understood to mean a mass flow which is to be discharged from the pressure accumulator.

The two operating ranges of the two valves are now preferably superimposed in such a way that a common continuous operating range is present from negative mass flows to positive mass flows. Thus, the switchover operations between the two closed-loop control circuits that are required in the case of conventional fuel injection systems are eliminated, thereby increasing the efficiency of the control and regulation function of the fuel injection system according to various embodiments.

The control unit is preferably implemented as model-based, the fuel mass being balanced in the pressure accumulator. Owing to fuel compressibility and a slight expansion of the pressure accumulator a fixed ratio exists between pressure in the pressure accumulator and fuel mass balance. The fuel flows being supplied and discharged, i.e. the leakages, the injection quantities and the two valves or control valves must be taken into account in order to form the fuel mass balance.

Figure 2:
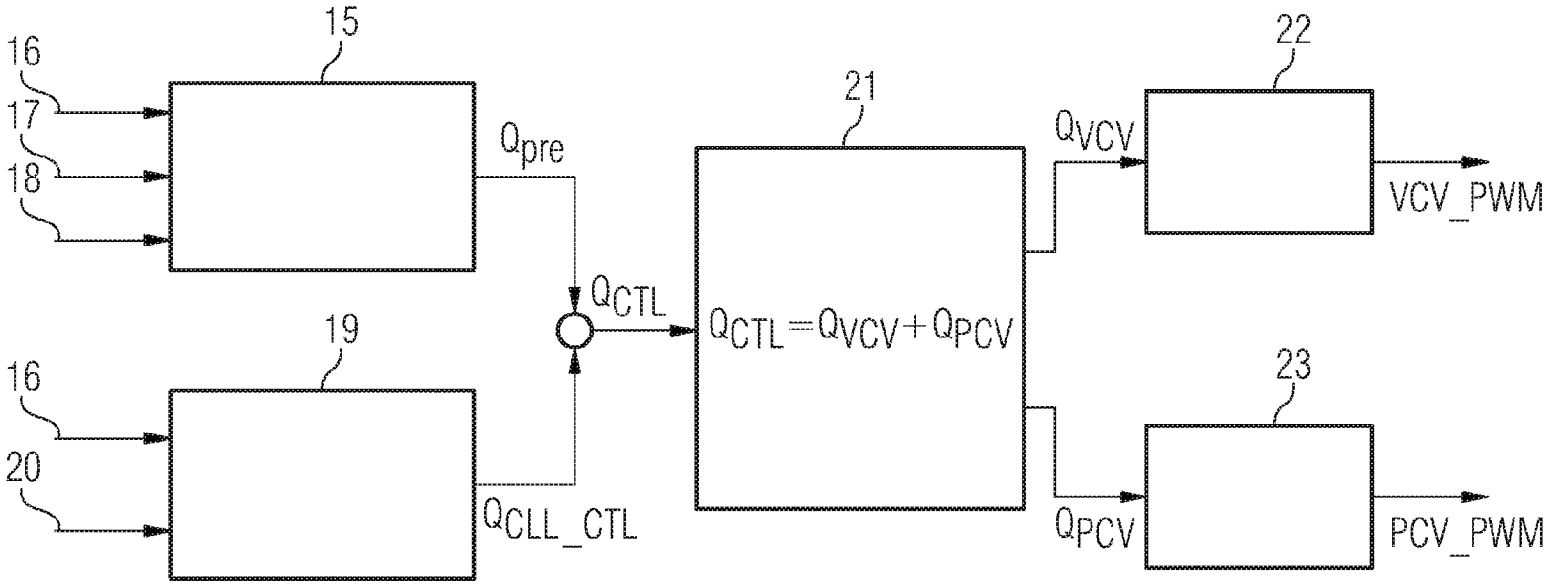
FIG. 2 shows a schematic representation intended to explain the regulation method performed by means of the control unit 11 of FIG. 1.

In the case of given injection quantities and with modulated leakages the control unit can influence the fuel mass balance across both control valves in such a way that the setpoint pressure is set in the pressure accumulator. At a first step the control unit advantageously specifies the required fuel mass flow or volume flow $Q_{CTL}$ (FIG. 2) across both control valves, the sum being formed from a precontrol (15; FIG. 2) and a closed-loop control (19; FIG. 2).

At a second step the control unit splits the required fuel mass flow into the mass flow fractions for both valves.

Figure 5:
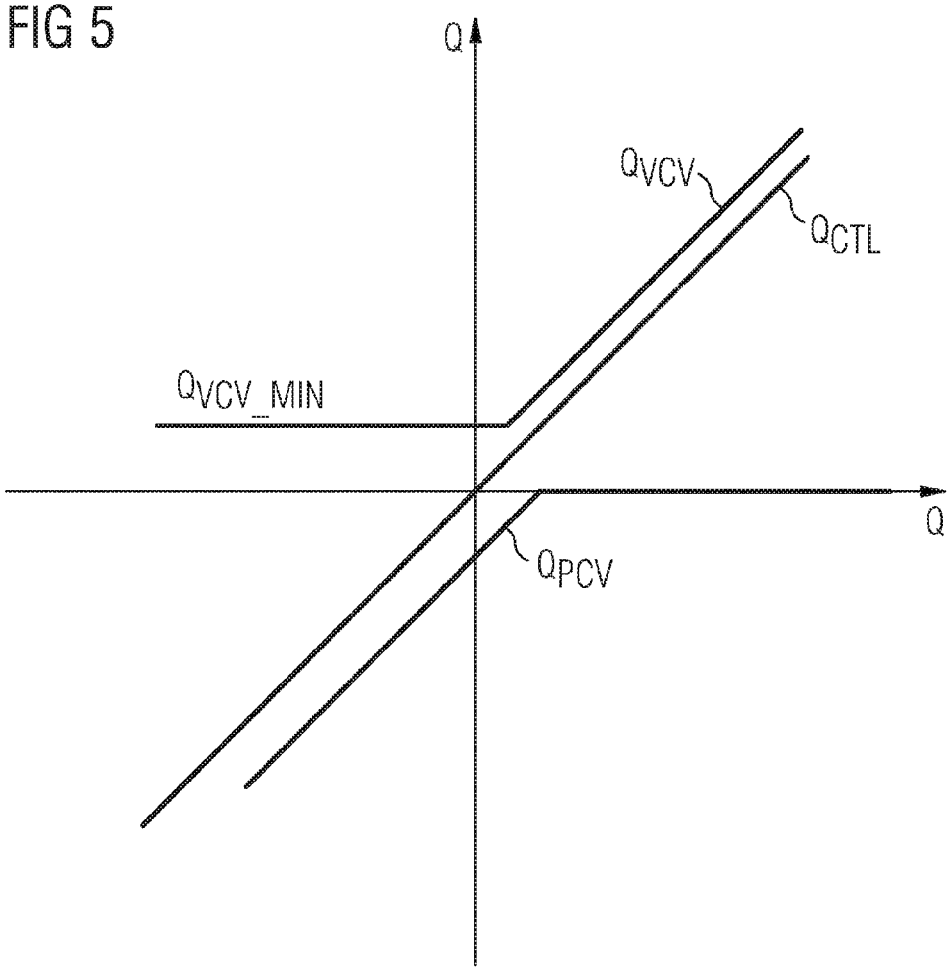
FIG. 5 shows a schematic representation intended to explain the common operating range of the two valves VCV, PCV of FIG. 1.

An advantageous splitting of the required fuel mass flow $Q_{CTL}$ into the valve flows $Q_{VCV}$ and $Q_{PCV}$ is shown in FIG. 5.

At a third step the actuating signal of the respective valve can be calculated as a function of at least one operating parameter, such as e.g. pressure in the pressure chamber, rotational speed of the internal combustion engine, . . . and the corresponding mass flow fraction. Compared with conventional models in which the pressure of the pressure chamber is calculated as a function of the actuating signal and, for example, the coefficient of pressure of the main pressure pump, these models can be referred to as inverse models.

In the fuel pressure regulation system according to various embodiments the control unit can be embodied as an accumulator pressure regulator (i.e. a regulator of the pressure in the pressure accumulator) which acts simultaneously on the two valves which serve as final control elements. In the fuel pressure regulation system according to various embodiments, therefore, the regulator must now computationally determine only a single actuating variable, namely the fuel mass flow. This is then split into the mass flow fractions and converted into actuating signals for the valves. Advantageously this also exploits the fact that the operating ranges of the two valves complement each other; in particular they can mutually complement each other to form a continuous operating range from negative to positive mass flows.

The fuel pressure regulation system can be developed as a fuel injection system, in particular as a common-rail injection system. Furthermore the fuel pressure regulation system according to various embodiments can be used for diesel internal combustion engines. The diesel internal combustion engines are in particular engines for passenger cars or freight vehicles.

In this case the pressure in the pressure accumulator can be regulated in a range between approx. 200 to approx. 2000 bar.

The internal combustion engine can, however, also be a gasoline internal combustion engine, in particular for passenger cars or freight vehicles. In this case the pressure in the pressure accumulator is usually considerably lower.

Furthermore, owing to the use of the fuel pressure regulation system in an internal combustion engine, an internal combustion engine having the fuel pressure regulation system according to various embodiments is made available.

Also provided is a fuel pressure regulation method for an internal combustion engine, said method having a pressure accumulator which stores fuel under pressure and feeds injectors providing combustion chambers of the internal combustion engine with fuel, a high-pressure pump which supplies a fuel mass flow to the pressure accumulator, a first valve for throttling the fuel mass flow, and a second valve via which fuel can be discharged from the pressure accumulator, wherein a fuel mass flow required by the pressure accumulator is determined as a function of a predefined setpoint pressure in the pressure accumulator, the determined fuel mass flow is split into a mass flow fraction that is to be supplied via the first valve and a mass flow fraction that is to be discharged via the second valve, and the valves are actuated according to the mass flow fractions.

With the fuel pressure regulation method according to various embodiments the operating ranges of the two valves can be superimposed in such a way that a continuous operating range is present from negative to positive fuel mass flows to the pressure accumulator. In particular the first valve can have a positive minimum fuel mass flow and greater values. The second valve can have an operating range from the mass flow zero in the direction of negative mass flows (i.e. an outflow from the pressure accumulator).

In particular the fuel pressure regulation method according to various embodiments enables an accumulator pressure regulating function for the pressure accumulator to be realized which simultaneously acts on the two valves which serve as final control elements.

Finally the valves can be actuated by means of models in which the actuating signal of the respective valve is determined as a function of at least one operating parameter of the internal combustion engine and the corresponding mass flow fraction.

Developments of the fuel pressure regulation system and of the fuel pressure regulation method according to various embodiments are also disclosed in the dependent claims.

It is to be understood that the above-cited features and the features that are still to be explained in the following can be used not only in the specified combinations, but also in other combinations or in isolation, without leaving the scope of the present invention.

In the embodiment variant shown in FIG. 1, the fuel pressure regulation system 1 comprises a fuel prefeed pump 2 and a main pressure pump 3 which are connected to each other via a line 4. A mass flow valve VCV is arranged in the line 4.

The output of the main pressure pump 3 (i.e. the high-pressure side) is connected via a line 5 to a pressure accumulator 6 of an internal combustion engine. The pressure accumulator 6, for its part, is connected to four injectors 7 which serve to feed the combustion chambers 8 (of which only one is shown in FIG. 1 in order to simplify the drawing) with fuel under high pressure (the pressure in the pressure accumulator 6). Accordingly the fuel pressure regulation system 1 is embodied as a fuel injection system.

The two pumps 2 and 3 form a high-pressure pump 9 which conveys the fuel from a tank 10 into the pressure accumulator 6 such that a predetermined pressure is present there.

The fuel pressure regulation system 1 also has a pressure limiting valve PCV which connects the output side of the main pressure pump 3 to the tank 10 and as a result can reduce the pressure in the pressure accumulator 6.

In addition the fuel pressure regulation system 1 includes a control unit 11 which actuates the two valves VCV and PCV (as indicated by means of the lines 12 and 13) and to which the actual pressure present in the pressure accumulator 6 is supplied, as indicated by means of the line 14.

During the operation of the fuel pressure regulation system 1 the control unit 11 determines the fuel mass flow $Q_{CTL}$ required by the pressure accumulator 6. As is apparent in particular from the schematic representation in FIG. 2, the required fuel mass flow $Q_{CTL}$ is composed of a preset fuel mass flow $Q_{Pre}$ and a closed-loop control fuel mass flow $Q_{CLL_CTL}$. The preset fuel mass flow $Q_{Pre}$ is determined by means of a first control submodule 15 as a function of e.g. the actual pressure in the pressure accumulator (indicated by arrow 16), the injection quantity of the injectors (indicated by arrow 17), the engine speed and the injection temperature of the fuel (indicated by arrow 18). The first control submodule 15 can also take into account assumptions relating to the injection, losses, etc. In this way the necessary mass flow inflow into the pressure accumulator 6 can advantageously be determined in a model-based manner as a function of the consumption (injectors 7), leakages and dynamic accumulator effects.

The closed-loop control fuel mass flow $Q_{CLL_CTL}$ is determined by means of a second control submodule 19, which in this case is embodied as a PID controller, as a function of the actual pressure (arrow 16) in the pressure accumulator 6 and the setpoint pressure (arrow 20) in the pressure accumulator 6.

The required fuel mass flow $Q_{CTL}$ is determined from the preset fuel mass flow $Q_{Pre}$ of the first control submodule 15 and the closed-loop control fuel mass flow $Q_{CLL_CTL}$ of the second correctively intervening control submodule 19 and supplied to a distributor module 21 of the control unit 11.

The distributor module 21 splits the required fuel mass flow $Q_{CTL}$ into a fuel mass flow $Q_{VCV}$ that is to be supplied via the mass flow valve VCV and a fuel mass flow $Q_{PCV}$ that is to be discharged via the pressure limiting valve PCV. The splitting is performed in such a way that the sum of the two fuel mass flows $Q_{VCV}$ and $Q_{PCV}$ yields the required fuel mass flow $Q_{CTL}$.

The value of the fuel mass flow $Q_{VCV}$ that is to be supplied is used as an input variable in a model 22 for the mass flow valve VCV which then outputs the corresponding actuating variable VCV_PWM (in this case for a pulse width modulation for actuating the valve VCV) to the mass flow valve VCV. In the same way the value of the fuel mass flow $Q_{PCV}$ that is to be discharged is used as an input variable in a model 23 for the pressure limiting valve PCV, such that the model 23 outputs the corresponding actuating variable PCV_PWM (in this case for a pulse width modulation for actuating the valve PCV) for the pressure limiting valve PCV. The actuating variables thus determined by means of the two models 22 and 23 are then applied by the control unit 11 to the two valves VCV and PCV, such that the fuel mass flow $Q_{CTL}$ required by the pressure accumulator 6 is present at the pressure accumulator 6. In other words fuel is supplied to or discharged from the pressure accumulator 6 in such a way that the setpoint pressure is present in the pressure accumulator 6.

Figure 3:
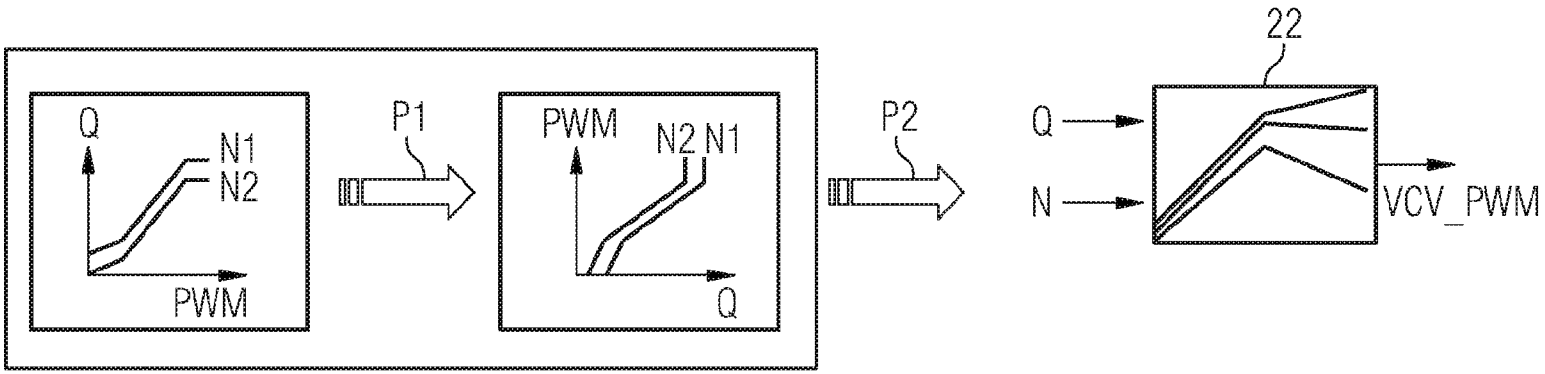
FIG. 3 shows a schematic representation intended to explain the model of the mass flow valve VCV of FIG. 1 used in the regulation method.
Figure 4:
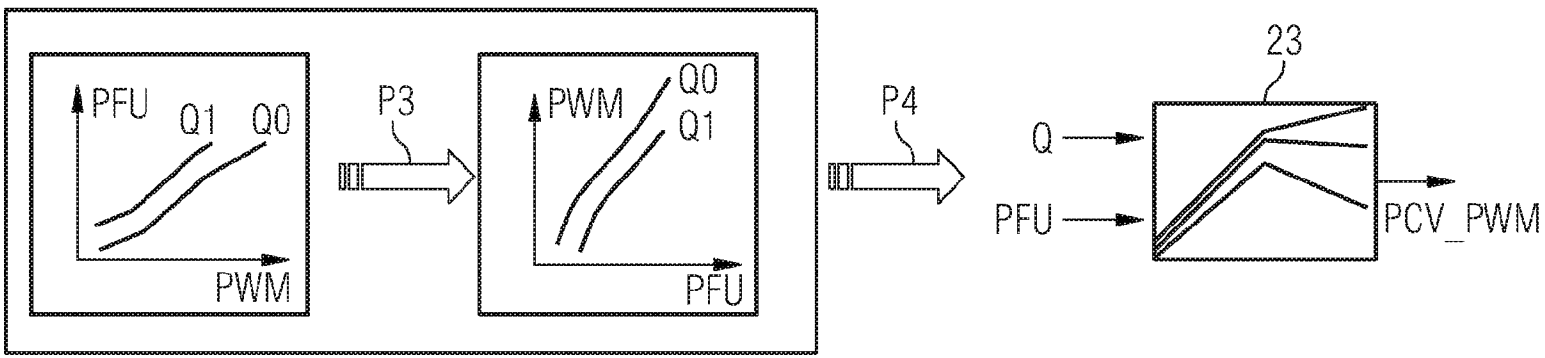
FIG. 4 shows a schematic representation intended to explain the model of the pressure limiting valve PCV of FIG. 1 used in the regulation method.

FIGS. 3 and 4 schematically show how the models 22 and 23 can be determined. Thus, FIG. 3 proceeds on the basis of an engine characteristic map for the mass flow valve VCV in which the mass flow Q is known as a function of a pulse width modulation (PWM) of the mass flow valve VCV for different rotational speeds N1, N2 of the internal combustion engine. Said engine characteristic map is inverted, as indicated by the arrow P1, and the model 22 is then derived from the inverted engine characteristic map, as indicated by the arrow P2, the model 22 outputting the pulse width actuation VCV_PWM of the mass flow valve VCV as a function of the mass flow Q and the rotational speed N.

The model 23 for the pressure limiting valve PCV can be derived in a similar manner. The model in this case is based on an engine characteristic map for determining the pressure PFU in the pressure accumulator as a function of the pulse width actuation PWM of the pressure limiting valve PCV for different mass flows Q0, Q1. Said engine characteristic map in turn is inverted (at P3) and the model 23 is derived from the inverted engine characteristic map (as indicated by the arrow P4). By means of the model 23 it is possible to determine the actuating signal PCV_PWM for the pressure limiting valve PCV for a mass flow Q and a pressure PFU in the pressure accumulator 6.

FIG. 5 shows the operating range of the two valves VCV and PCV individually (labeled $Q_{VCV}$ and $Q_{PCV}$). Also shown is the continuous operating range (labeled $Q_{CTL}$) composed of said two operating ranges.

The curve $Q_{VCV}$ shows the operating range of the mass flow valve VCV. The minimum settable mass flow value is a positive value $Q_{VCV_MIN}$, such that said mass flow $Q_{VCV_MIN}$ is always supplied to the pressure accumulator 6 or the line 5 via the high-pressure pump 9. The operating range of the mass flow valve VCV extends from said minimum value in the direction of greater values, as can be seen in FIG. 5.

The operating range of the pressure limiting valve PCV has the value zero as its maximum value. In this case no mass flow is discharged from the pressure accumulator 6. The operating range of the pressure limiting valve PCV extends from said maximum value in the direction of smaller, negative values, which means that the fuel mass flow discharged from the pressure accumulator 6 increases.

The two operating ranges of the two valves VCV and PCV are now superimposed by means of the described regulating function to form a single, continuous operating range $Q_{CTL}$ in which the fuel mass flow can be set continuously from negative values to positive values.

If the required fuel mass flow $Q_{CTL}$ is greater than $Q_{VCV_MIN}$, $Q_{VCV}=Q_{CTL}$ and $Q_{PCV}=0$ can be selected. If the required fuel mass flow is $Q_{CTL}\leqq Q_{VCV_MIN}$, $Q_{VCV}=Q_{VCV_MIN}$ and $Q_{PCV}=Q_{CTL}-Q_{VCV_MIN}$ can be selected.

By means of said described control function it is therefore possible to cover all operating states of the fuel injection system, with only a single control and regulating means (control unit 11) needing to be provided for that purpose. This reduces the cost and overhead by comparison with conventional systems.

Also eliminated completely is the conventionally usual switching over between two different closed-loop pressure control circuits, thereby simplifying the control unit overall. The malfunctions frequently occurring during the switchover operations are also eliminated completely.

The fuel pressure regulation system can be used with diesel or spark ignition engines.

What is claimed is:

1. A fuel pressure regulation system for an internal combustion engine, comprising:

a pressure accumulator which stores fuel under pressure and feeds injectors supplying combustion chambers of the internal combustion engine with fuel, wherein the pressure accumulator has an associated leakage rate dependent at least in part on the pressure of the fuel therein, a high-pressure pump which supplies a fuel mass flow to the pressure accumulator, a first valve for throttling the fuel mass flow, a second valve via which fuel can be discharged from the pressure accumulator, and a control unit for actuating the valves, wherein the control unit is operable:

to determine a fuel mass flow required by the pressure accumulator based at least in part on a function of a predefined setpoint pressure in the pressure accumulator, the associated leakage rate, and injection quantities required by the injectors, to split the determined fuel mass flow into a mass flow fraction that is to be supplied via the first valve and a mass flow fraction that is to be discharged via the second valve, and to actuate the valves according to the mass flow fractions.

2. The fuel pressure regulation system according to claim 1, wherein the control unit superimposes the operating ranges of the two valves in such a way that a continuous operating range is present from negative to positive fuel mass flows to the pressure accumulator.

3. The fuel pressure regulation system according to claim 1, wherein the control unit is embodied as an accumulator pressure regulator which acts simultaneously on the two valves which serve as final control elements.

4. The fuel pressure regulation system according to claim 1, wherein in order to actuate the valves the control unit uses models in which the actuating signal of the respective valve is determined as a function of at least one operating parameter of the internal combustion engine and of the corresponding mass flow fraction.

5. The fuel pressure regulation system according to claim 1, wherein the required fuel mass flow is calculated by means of the sum of a precontrol fraction and a closed-loop control fraction as a function of at least one operating parameter of the internal combustion engine.

6. The fuel pressure regulation system according to claim 5, wherein the precontrol fraction is calculated on the basis of a model.

7. The fuel pressure regulation system according to claim 5, wherein the precontrol fraction is calculated such that the required fuel mass flow is yielded as the result from the setpoint pressure in the pressure accumulator and the fuel mass balance of the pressure accumulator.

8. The fuel pressure regulation system according to claim 7, wherein the fuel mass balance is calculated from the injection quantities, the switching leakages, the continuous leakages and the fuel mass stored in the pressure accumulator as a function of a setpoint change rate of the pressure in the pressure accumulator and as a function of the actuated valves.

9. The fuel pressure regulation system according to claim 8, wherein the precontrol value is calculated by resolving the fuel mass balance according to the valve dependencies.

10. A fuel pressure regulation method for an internal combustion engine comprising a pressure accumulator which stores fuel under pressure and feeds injectors supplying combustion chambers of the internal combustion engine with fuel, wherein the pressure accumulator has an associated leakage rate dependent at least in part on the pressure of the fuel therein, a high-pressure pump which supplies a fuel mass flow to the pressure accumulator, a first valve for throttling the fuel mass flow, a second valve via which the fuel can be discharged from the pressure accumulator, the method comprising:

determining a fuel mass flow required by the pressure accumulator based at least in part on a function of a predefined setpoint pressure in the pressure accumulator the associated leakage rate, and injection quantities required by the injectors, splitting the determined fuel mass flow into a mass flow fraction that is to be supplied via the first valve and a mass flow fraction that is to be discharged via the second valve, and actuating the valves according to the mass flow fractions.

11. The method according to claim 10, wherein the operating ranges of the two valves are superimposed such that a continuous operating range is present from negative to positive fuel mass flows to the pressure accumulator.

12. The method according to claim 10, wherein an accumulator pressure regulation and control function is realized which acts simultaneously on the two valves which serve as final control elements.

13. The method according to claim 10, wherein models are used for the purpose of actuating the valves, in which models the actuating signal of the respective valve is determined as a function of at least one operating parameter of the internal combustion engine and of the corresponding mass flow fraction.

14. The method according to claim 10, further comprising:

calculating the required fuel mass flow by means of the sum of a precontrol fraction and a closed-loop control fraction as a function of at least one operating parameter of the internal combustion engine.

15. The method according to claim 14, wherein the precontrol fraction is calculated on the basis of a model.

16. The method according to claim 14, wherein the precontrol fraction is calculated such that the required fuel mass flow is yielded as the result from the setpoint pressure in the pressure accumulator and the fuel mass balance of the pressure accumulator.

17. The method according to claim 16, wherein the fuel mass balance is calculated from the injection quantities, the switching leakages, the continuous leakages and the fuel mass stored in the pressure accumulator as a function of a setpoint change rate of the pressure in the pressure accumulator and as a function of the actuated valves.

18. The method according to claim 17, wherein the precontrol value is calculated by resolving the fuel mass balance according to the valve dependencies.

* * * * *